United States Patent [19]

Hills

[11] 4,110,571

[45] Aug. 29, 1978

[54] TEST UNIT FOR STEREOPHONIC SPEAKER SYSTEMS

[75] Inventor: Joseph F. Hills, Scottsdale, Ariz.

[73] Assignee: Jimmy's Radio & Television Corporation, Phoenix, Ariz.

[21] Appl. No.: 854,761

[22] Filed: Nov. 25, 1977

[51] Int. Cl.[2] ..... H04R 29/00

[52] U.S. Cl. ..... 179/175.1 A; 179/1 MN; 179/1 VE; 324/51

[58] Field of Search ..... 179/175.1 A, 1 MN, 1 VE, 179/175.3; 340/409, 214; 325/363; 324/51, 52, 133

[56] References Cited

U.S. PATENT DOCUMENTS

| | | | |
|---|---|---|---|
| 3,217,244 | 11/1965 | Glover | 324/51 |
| 3,467,867 | 9/1969 | Armes et al. | 179/1 VE |
| 3,849,772 | 11/1974 | Burnett | 324/51 |
| 3,855,415 | 12/1974 | Fox et al. | 179/1 MN |
| 3,989,908 | 11/1976 | Budrys et al. | 179/1 MN |

*Primary Examiner*—Kathleen H. Claffy
*Assistant Examiner*—Gerald L. Brigance
*Attorney, Agent, or Firm*—Cahill, Sutton & Thomas

[57] ABSTRACT

A test unit determines the existence of open or short circuits within the speakers and speaker wire harness of a stereophonic front and rear speaker system in a vehicle. The test unit, having a buzzer incorporated therein, is directly electrically attached to the speaker wire harness through an existing harness plug, which plug includes a lead for supplying electric power from the vehicle battery to the test unit. A rotary switch, mounted upon the test unit and operating in conjunction with a test unit mounted toggle switch, serially tests for both open and short circuits in each speaker and the wire harness leading to and from each speaker. An audible tone emanating from the buzzer and/or a speaker provides an indication of an open or short circuit condition and identifies the location of the fault.

10 Claims, 3 Drawing Figures fig. 1
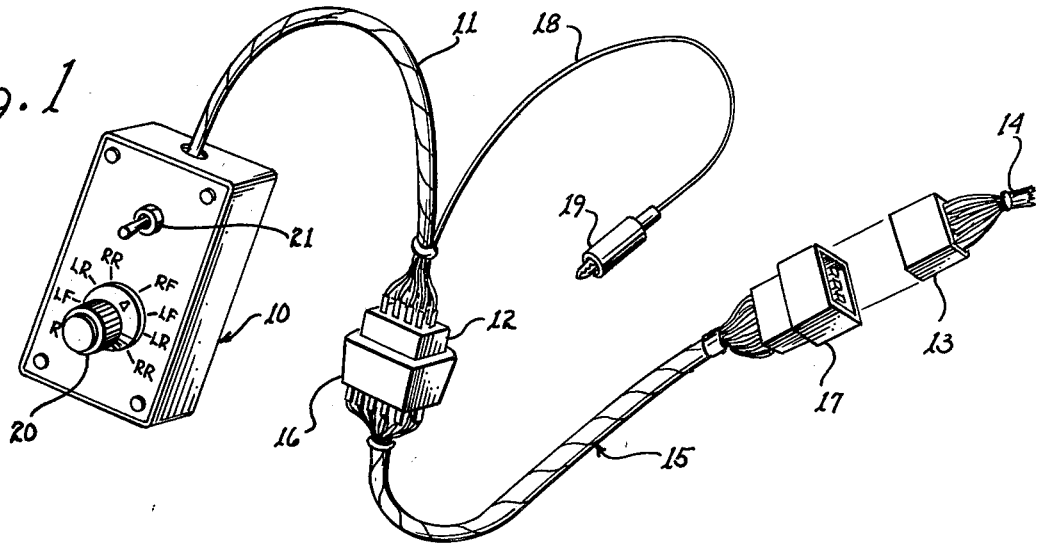
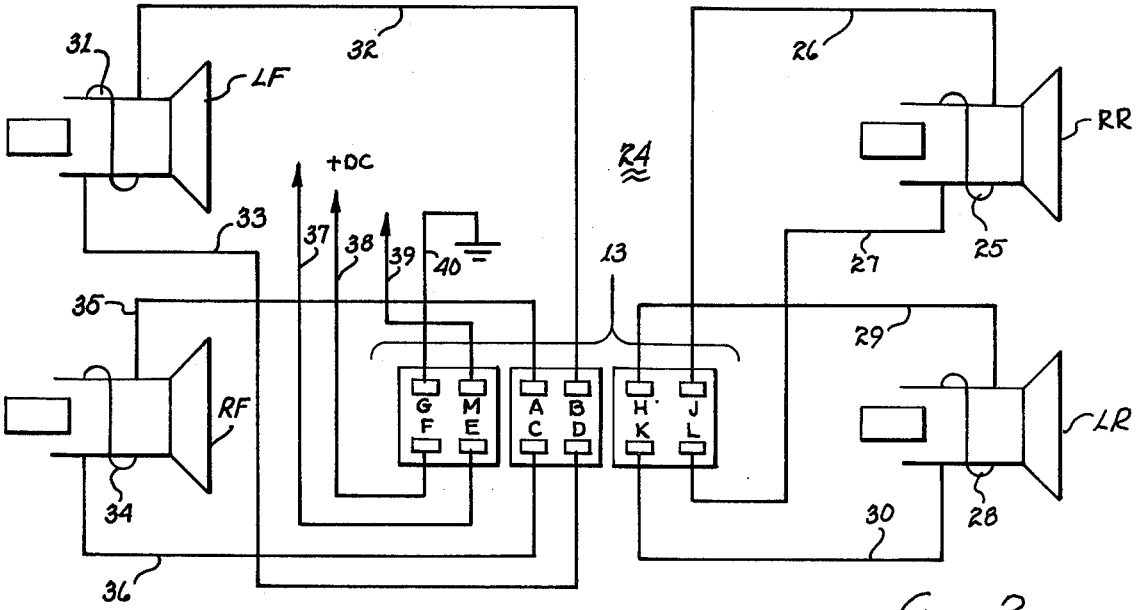
fig. 2
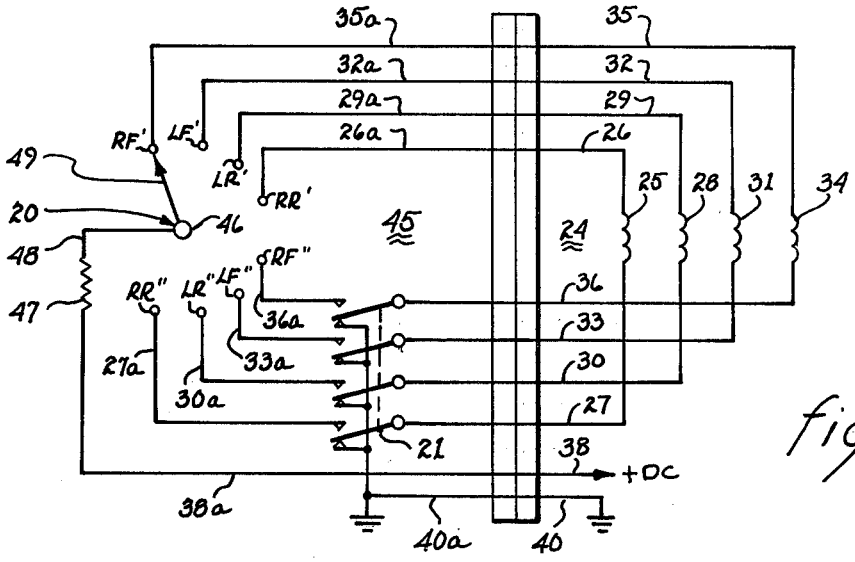
fig. 3

TEST UNIT FOR STEREOPHONIC SPEAKER SYSTEMS

The present invention relates to test units and, more particularly, to plug in test units for vehicular mounted speaker systems and attendant wire harnesses.

Presently, the integrity of speakers and wire harnesses therefor in vehicular speaker systems are tested using ohm meters or continuity meters. This process is very laborious and time consuming, requiring segregation and testing of the multiple components attendant the speaker system. Moreover, when an ohm meter is used, some skill must be exercised to accurately interpret the readings provided by the meter.

In 1977 and 1978, most automotive vehicles manufactured by General Motors incorporating a stereo receiver, the return path from the speakers is not at ground potential. Should the speakers or the speaker harness become short circuited or grounded, the output stage of the vehicular radio will become overloaded and irreparably damaged. Since the present retail cost of replacing the damaged output stage for a stereophonic radio is $40.00, it is in the interest of both the repair facility and the vehicle owner to minimize the labor necessary to trace the fault and perform the necessary repair as well as replacement of the output stage. Should the vehicle still be under warranty, the manufacturer must generally bear the cost to its detriment.

The test unit described herein is plugged directly to the speaker harness plug after the latter has been disconnected from the radio. This plug includes terminals for the wire harness leading to all of the speakers and includes further terminals leading to the vehicular mounted battery, electric antenna extension/retraction unit and dial light dimmer switch. Thus, the test unit is connectable not only to the speaker system but also to a source of electric power.

A rotary switch, in combination with a toggle switch, sequentially provides electric current to the wire harness of each speaker and each speaker with its attendant wire harness is tested for both a short circuit and an open circuit condition. The existence of an open circuit or short circuit is determined by actuation of a buzzer within the test unit and/or the generation of a buzzing sound from the speaker under test. Depending upon the audible noise generated at each position of the rotary switch and the toggle switch, the existence of either an open circuit or a short circuit can be determined as well as the location of the fault in the wires or in the speaker.

It is therefore a primary object of the present invention to provide a plug in test unit for speaker systems in automobiles.

Another object of the present invention is to provide a test unit powered by the vehicular mounted battery to test the speaker system within the vehicle.

Yet another object of the present invention is to provide a means for testing for both open and short circuit conditions within the speaker system through sequential positioning of a rotary switch.

Still another object of the present invention is to provide a test unit for locating an open or short circuit condition within a vehicular speaker system.

A further object of the present invention is to provide a plug in test unit for testing ungrounded stereophonic speaker systems.

A yet further object of the present invention is to provide a plug in test unit for speaker systems which provides an indication of the status of the components thereof through the generation of an audible signal.

A still further object of the present invention is to provide a plug in test unit for speaker systems which identifies the location of a fault through selective generation of an audible signal.

These and other objects of the present invention will become apparent to those skilled in the art as the description thereof proceeds.

The present invention may be described with greater specificity and clarity with reference to the following drawings, in which:

FIG. 1 is a perspective view illustrating an embodiment of the test unit.

FIG. 2 is a pictorial diagram illustrating the speaker system to be tested.

FIG. 3 is a schematic diagram illustrating the circuit of the test unit in combination with the circuit of the speaker system under test.

The present invention was conceived and reduced to practice in an effort to provide a rapid and facile method for testing a stereophonic speaker system in vehicles manufactured by General Motors Corporation. The previous and still used conventional method of testing such speaker systems involves the use of an ohm meter or a continuity meter to check individual wire harness components and the individual speakers themselves. This method is very time consuming and generally requires some expertise in correctly interpreting the meter readings obtained. Since the costs attendant repairs to the speaker system necessarily include the cost of the labor spent in determining the cause of the failure, cost alone is substantial.

Beginning in 1977, the speaker systems for General Motor's stereo radios were not grounded and a short to ground therein overloads the output stage with destructive consequences. The replacement parts necessary for the output stage presently retail at $40.00 and when this cost in combination with the labor involved in tracing the fault within the speaker or wire harness therefor are summed, the total cost seems exorbitant.

In an effort to minimize the cost to the consumer or to the automobile manufacturer, if the components are under warranty, the test unit described herein was developed. In essence, the test unit plugs directly into the speaker harness plug normally plugged to the output terminals of the vehicle radio. Thus, the individual wires and speakers need not be traced and tested. The unit itself receives power for operation from the vehicle mounted battery and thus avoids the need for a separate power source. The test unit includes a rotary switch for testing each speaker and its attendant wire harness and a toggle switch for testing each speaker and each wire harness under both short circuit and open circuit conditions. Should a fault be present, a buzzer mounted internal to the test unit and/or the speaker under test will emit an audible signal. Depending upon the test mode, the presence or absence of audible signal and its source immediately identifies the component in which the fault exists.

Referring to FIG. 1, there is shown a test unit 10 having a wire harness extending therefrom and terminating in a plug 12. The plug mates with a corresponding plug 13 attached to the speaker system wire harness 14. An extension harness 15, having plugs 16 and 17 disposed at the ends thereof, may be employed to render use of test unit 10 more convenient for the operator. A ground lead 18 having an alligator clip 19 disposed at the end thereof extends from plug 12 to provide a ground for testing particular ungrounded speaker harnesses, such as those found in the 1977 Cadillacs.

Test unit 10 includes a rotary switch 20 for sequentially testing each speaker and the harness attendant thereto. The first four positions of the rotary switch test for an open circuit condition and all eight positions are employed to test for a short circuit condition. A toggle switch 21, on actuation, performs the necessary circuit changes to test for either open or short circuit conditions.

The speaker and wire harness system 24 to be tested is illustrated in FIG. 2. Right rear speaker RR includes a coil 25 having leads 26 and 27 connected to terminals J and L, respectively of plug 13. The left rear speaker, LR, includes a coil 28 having leads 29 and 30 extending from terminals H and K, respectively. Left front speaker LF includes a coil 31 having leads 32 and 33 connected to terminals B and D, respectively. Right front speaker RF includes a coil 34 having leads 35 and 36 connected to terminals A and C, respectively. Terminal E of plug 13 provides electrical power through lead 37 to ancillary electrical systems, such as an antenna retraction mechanism. Terminal F is connected to the positive terminal of the vehicular battery and provides power through lead 38 to test unit 10 (See FIG. 1). Terminal G is grounded through lead 40. However, as discussed above, certain vehicles may not include a ground connection, in which case lead 18 and alligator clip 19 (electrically connected to terminal G) are employed. Terminal M provides power through lead 39 to ancillary electrical equipment such as a dial light dimmer.

From the above discussion with respect to FIG. 2, it becomes apparent that plug 13 provides a source of power to the test unit; provides a ground, either directly or through lead 18, and also provides interconnection with each of the leads associated with each of the speakers.

Test circuit 45 contained within test unit 10 and connected to wire harness system 24 on the mating of plugs 12 and 13 is illustrated in FIG. 3. On mating of plugs 12 and 13, power is supplied to center contact 46 of rotary switch 20 (an eight position break before make rotary switch) through lead 38, lead 38*a*, buzzer 47 and lead 48. Wiper 49 of the rotary switch is sequentially positionable at the first series of terminals RF′, LF′, LR′, and RR′, which designations, without the prime mark, correspond to the left hand designations on the fact of test unit 10 (see FIG. 1). The wiper arm is also sequentially positionable at any one of a second series of positions designated RF″, LF″, LR″, and RR″, which designations, without the double prime mark, correspond to the right hand designations on the fact of test unit 10 (see FIG. 1). Each of these positions is connected through leads 35*a*, 32*a*, 29*a*, 26*a*, 36*a*, 33*a*, 30*a*, 27*a*, to the corresponding leads of plug 13 on mating of plugs 12 and 13. Toggle switch 21 is a four pole double throw break before make switch having a first position grounding leads 36, 33, 30, and 27 through lead 40*a* and a second position electrically connecting these leads to the respective ones of leads 36*a*, 33*a*, 30*a* and 27*a*.

In operation, the steps for testing the system are as follows. Switch 21 is placed in the open position (grounding leads 36, 33, 30 and 27). Rotary switch 20 is rotated such that wiper 49 sequentially contacts each of positions RF′, LF′, LR′ and RR′. At each position, current, supplied from lead 38, will energize buzzer 47 and the respective one of coils 34, 31, 28 and 25 since leads 36, 33, 30 and 27 are grounded. Accordingly, the buzzer and the energized one of the coils will emit an audible tone, assuming the coil itself is not open circuited or short circuited or that none of the speaker leads are open circuited. In the event a particular speaker under test does not emit an audible tone but buzzer 47 so does, one of leads 35, 32, 29 or 26 is grounded. Should a speaker not under test, as determined by the indicia on the face of the test unit, emit an audible tone, the lead under test is disconnected from its speaker and shorted to the lead attached to the speaker emitting the audible tone. In the event two or more speakers emit a tone along with buzzer 47, one of leads 35, 32, 29 or 26 is shorted with the lead under test. On positioning switch 20 to one of the second series of positions, no sound should be heard from any of the speakers or from the buzzer.

Should all speakers appear to function properly or if one of the speakers malfunctions, these facts are documented before proceeding with a second test.

In the second test, switch 21 is placed in the short circuit position, which position interconnects leads 36, 33, 30 and 27 with leads 36*a*, 33*a*, 30*a* and 27*a*, respectively. Rotary switch 20 is rotated such that wiper 49 sequentially contacts each of positions RF′ to position RR″. In these positions of switch 20, all of the leads attendant speaker coils 34, 31, 28 and 25 will be ungrounded unless a fault exists. Thus, on rotation of rotary switch 20, no sound should be emitted from any of the speakers or from buzzer 47. In the event the buzzer emits a tone without a tone being emitted by the speaker under test, one of leads 35, 32, 29, 26, 36, 33, 30 or 27 is grounded to the chassis between plug 13 and the coil of the speaker under test. In the event both the buzzer and a speaker under test emit an audible tone, the corresponding lead of the series of positions not under test is shorted to the chassis.

By analyzing the results obtained in each of the tests described above, it will be immediately apparent to the operator whether a short circuit condition or an open circuit condition exists. Moreover, it will be just as apparent to the operator whether the fault exists within one of leads 35, 32, 29, 26, one of coils 34, 31, 28, 25 or one of leads 36, 33, 30 and 27.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A test unit for providing an audible indication of both the existence and location of open and short circuit conditions within a multiple speaker system having a multi-terminal plug electrically connected to individual leads of first and second groups of leads extending from respective first and second sides of the coils of the speakers and including a power lead extending from a source of electrical power and a grounded lead, said test unit comprising in combination:

(a) a multi-position break before make switch, said multi-position switch including a center terminal, a first series of terminals, a second series of terminals and means for selectively electrically connecting said center terminal to any terminal of said first or second series of terminals;

(b) means for electrically connecting each terminal of said first series of terminals to one lead of the first group of leads and for electrically connecting each terminal of said second series of terminals to one lead of the second group of leads;

(c) means for interconnecting said center terminal with the power lead, said interconnecting means including a buzzer; and (d) a multi-pole double throw break before make switch for selectively disconnecting the second group of leads from said second series of terminals and grounding the second group of leads.

2. The test unit as set forth in claim 1 wherein said multi-position switch is a rotary switch.

3. The test unit as set forth in claim 2 wherein the speaker system is a four speaker system and said rotary switch comprises an eight position switch.

4. The test unit as set forth in claim 3 wherein said multi-pole switch is a four pole switch.

5. The test unit as set forth in claim 4 wherein each terminal of said first series of terminals is electrically connected to a corresponding terminal of said second series of terminals through a lead of the first group of leads, one speaker coil of the speaker system, a lead of the second group of leads and a corresponding contact in said multi-pole Switch.

6. The test unit as set forth in claim 5 including a chassis for mounting said rotary switch and said four pole switch.

7. The test unit as set forth in claim 6 further including indicia disposed upon said chassis for identifying the speaker lead corresponding to the terminal interconnected by said connecting means to said center terminal.

8. The test unit as set forth in claim 1 wherein each terminal of said first series of terminals is electrically connected to a corresponding terminal of said second series of terminals through a lead of the first group of leads, one speaker coil of the speaker system, a lead of the second group of leads and a corresponding contact in said multi-pole Switch.

9. The test unit as set forth in claim 8 including a chassis for mounting said rotary switch and said multi-pole switch.

10. The test unit as set forth in claim 9 further including indicia disposed upon said chassis for identifying the speaker lead corresponding to the terminal interconnected by said connecting means to said center terminal.

* * * * *